US006715634B2

(12) United States Patent
Knol

(10) Patent No.: US 6,715,634 B2
(45) Date of Patent: Apr. 6, 2004

(54) DISPENSING BOX PROVIDED WITH AN INTEGRAL HANDLE

(75) Inventor: Will Knol, Bergum (NL)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 10/156,835

(22) Filed: May 30, 2002

(65) Prior Publication Data

US 2003/0094461 A1 May 22, 2003

(Under 37 CFR 1.47)

Related U.S. Application Data

(63) Continuation of application No. PCT/EP00/10578, filed on Oct. 27, 2000.

(30) Foreign Application Priority Data

Nov. 30, 1999 (EP) ..... 99850186

(51) Int. Cl.[7] ..... A47K 10/24
(52) U.S. Cl. ..... 221/45; 229/199
(58) Field of Search ..... 221/33, 45, 46, 221/47, 63; 229/199, 221, 117.13

(56) References Cited

U.S. PATENT DOCUMENTS 4,478,354 A 10/1984 Notheis

FOREIGN PATENT DOCUMENTS

| | | | |
|---|---|---|---|
| DE | 77 10 736 | | 7/1977 |
| FR | 2 777 259 | | 10/1999 |
| GB | 2 186 550 A | | 8/1987 |
| GB | 2211174 | * | 6/1989 |
| WO | WO 81/00090 | * | 1/1981 |
| WO | 98/38099 | | 9/1998 |
| WO | 0 870 688 A1 | | 10/1998 |

* cited by examiner

*Primary Examiner*—Kenneth W. Noland
(74) *Attorney, Agent, or Firm*—Burns, Doane, Swecker & Mathis, LLP

(57) ABSTRACT

A box formed from a blank of stiff but foldable board material, the box including a top (2) panel, a bottom panel (3), two side panels (4,5) and two end panels (6,7) connected together at fold lines (8-8$^{xi}$) to form an enclosure, wherein the top panel (2) is formed by end panel flaps (9,10) extending from the end panels (6,7) towards each other and by side panel flaps (11,12) extending from the side panels (6,7) towards each other, the side panels flaps (11,12) are connected to each other by a tape (13) extending from one of the end panels (6) to the other end panel (7). The side panel flaps (11,12) are each provided with perforations defining a dispensing opening (17,18), wherein portions (19, 20) of each side panel flap (11,12) separating the dispensing openings (17,18) together with the tape (13) are adapted to form a handle (14).

15 Claims, 2 Drawing Sheets

DISPENSING BOX PROVIDED WITH AN INTEGRAL HANDLE

This application is a continuation of PCT/EP00/10578, filed Oct. 27, 2,000.

TECHNICAL FIELD OF THE INVENTION

The present invention relates to a box, a blank for a box and an article dispenser. Particularly the invention relates to a box, a blank for a box and an article dispenser wherein a box, a blank or an article dispenser includes dispensing openings provided in one of the panels forming a box or article dispenser. More particularly the invention relates to a box, a blank for a box and an article dispenser wherein a box, a blank or an article dispenser wherein the dispensing opening is used to give access to a handle. The invention also relates to a method of providing a reinforced handle on a box having perforations defining dispensing openings.

BACKGROUND OF THE INVENTION

Dispensing systems or boxes for dispensing articles, and in particular sheet products such as cloth, paper, tissue or nonwoven wipes from a box are well known in the art.

Such dispensing systems or boxes are generally manufactured from a blank of stiff but foldable board material comprising a top panel, a bottom panel, side panels and a first and a second end panel connected together at fold lines to form an enclosure, wherein said top panel is formed by a first set of end panel flaps extending from the end panels and by a first set of side panel flaps extending from the side panels and said bottom panel is formed by a second set of end panels flaps extending from the end panels and by a second set of side panel flaps extending from the side panels.

For instance, U.S. Pat. No. 4,478,354 relates to a package for dispensing interfolded wipers through dispensing openings provided in a side panel of the package. The package is provided with two dispensing openings separated by a part of a panel functioning as a handle. Since the board material making up the box is not sufficiently rigid and resistant to tear, the handle can easily break.

EP 870 688 relates to a box, which is easily dismantled and packed flat after use to save space on disposal or recycling. The box is provided with a separate reinforced handle. The necessity to provide separate reinforcement adds to the complexity of the manufacturing process of the box and thus to the price of the box. This box is not provided with a dispensing opening and is referred to only as an example where additional means of reinforcement for providing a sufficiently strong handle are included.

WO 98/38099 relates to an article carrier having an elongated handle strap formed between two dispensing openings in a side panel of the box.

In all of the embodiments shown in the prior art, the dispensing openings and thus a handle formed by a part of the panel separating the dispensing openings are provided in a side panel of the box. The side and end panels are normally formed from a single ply of the blank when manufacturing a box from a blank. Thus, if the dispensing openings and the handle are provided in a side panel, the handle will suffer from lack of rigidity and tearing strength. A second drawback of providing the handle and dispensing opening at a side panel is that, if additional strength is required at the handle, there is a need for incorporating additional elements for increasing the rigidity and tearing resistance.

SUMMARY OF THE INVENTION

One of the objects of the present invention is to provide a box including dispensing openings provided in an area of the box where extra rigidity is provided by the co-operation between folded parts of the blank A second object of the invention is to provide a reinforcement for a handle for a box having dispensing openings provided in one of the panels forming the box, wherein a portion of the panel separating the dispensing openings is functioning as the handle, without the need of adding any additional otherwise unnecessary reinforcing elements.

These objects are achieved by a providing a box according to the characterising portion of claim 1. By providing the dispensing openings at a top panel formed by side panel flaps and end panel flaps the openings are provided in a region of the box having an additional rigidity resulting from the folded flaps forming the top panel of the box. Furthermore, by providing the dispensing openings and the handle at the top panel, a tape provided for sealing the box can be used as reinforcement for the handle. Thus, the use of additional reinforcing elements having a sole use only as reinforcement is avoided.

In a first preferred embodiment of the invention, flaps extending from the end panels forming part of the top panel are glued to the side panels flaps, thereby increasing the rigidity of the box and the strength of the handle.

In a second preferred embodiment each dispensing opening extends, in a direction from end panel to end panel, between side portions of the dispensing opening and each end panel flap having a length, positioning a remote edge of each flap at a close distance to said side portions. By making the end panel flaps sufficiently long so as to reach, but not cover, part of the dispensing opening the top panel and the handle are given additional strength.

Here, and in the following a remote edge of a flap is defined as the free edge of the flap that is positioned on the opposite side of the flap to the fold line between the flap and the panel.

In a third preferred embodiment perforations defining each dispensing opening are provided, which perforations extend from a starting point to an end point leaving a non-perforated gap used as a hinge for a lid defined by part of each side panel flap enclosed by said perforations and said gap. By providing a hinge, the lid is enabled to be opened for providing access to the interior of the box via the dispensing opening and to be closed for providing dust protection of the interior of the box.

In a fourth preferred embodiment, the dispensing opening comprises a handle portion extending substantially parallel to a remote edge of each side panel flap and side portions extending from the handle portion, wherein a transition from the handle portion to the side portions has a curvature radius of at least 10 mm, preferably at least 15 mm. By providing a curvature radius at the transition from the handle portion to the side portions having a radius of at least 10 mm, the risk of occurrence of tearing at the transition is reduced, by providing a curvature radius at the transition from the handle portion to the side portions having a radius of at least 15 mm, the risk of occurrence of tearing at the transition is further reduced.

In a fifth preferred embodiment of the invention, the tape used for sealing of the box and reinforcement of the handle is reinforced by fibers. The fibers could be provided in the form of continuous filaments or yarns.

A further object of the invention is to provide a blank for a box including dispensing openings adapted to be provided in an area of the box where extra rigidity is provided resulting from the co-operation between folded parts of the blank.

A still further object of the invention is to provide a blank for a box having dispensing openings provided in a panel of the box, said dispensing openings being separated by part of said panel, wherein the part of the panel separating the dispensing openings forms a handle, where the handle is adapted to be reinforced by the sealing means of the box.

One or more objects of the invention are achieved by providing a blank according to the characterising portion of claim 11.

A further object of the invention is to provide an article dispenser making use of a box according to the invention.

This object is achieved by an article dispenser according to claim 12.

A further object of the invention is to provide a method of providing a reinforced handle on a box having perforations defining dispensing openings.

This object is achieved by the methods according to claims 13 and 14.

A still further object of the invention is to provide a box having a single dispensing opening providing access to a handle where the handle is reinforced without the need of adding any additional otherwise unnecessary reinforcing elements.

This object is achieved by a box according to the characterising portion of claim 15.

BRIEF DESCRIPTION OF THE DRAWINGS

The invention will in the following be further described in non-limiting way with reference to the accompanying drawings in which.

DETAILED DESCRIPTION OF THE INVENTION

Figure 1:
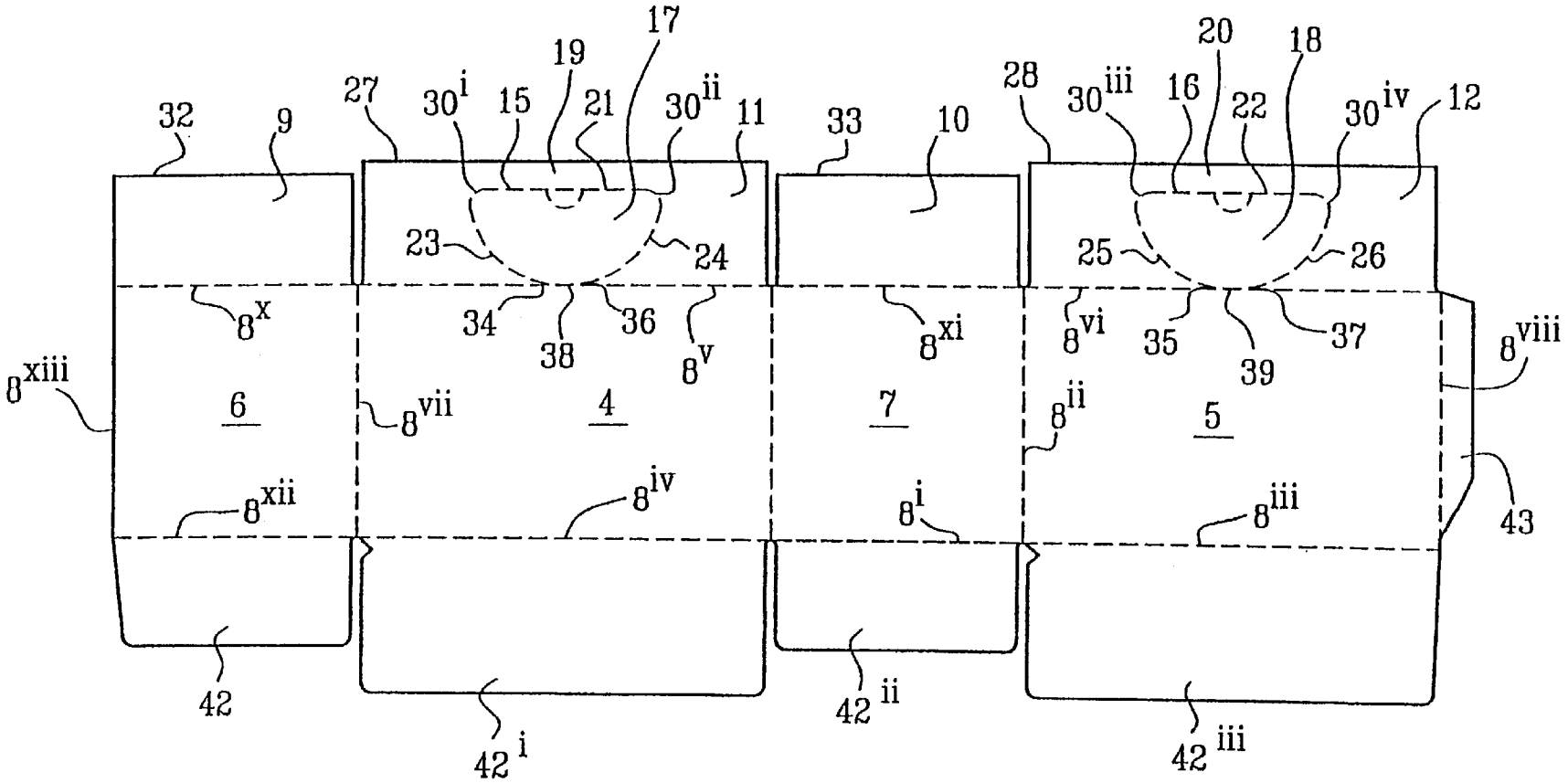
FIG. 1 schematically illustrates an embodiment of a box according to the invention.
Figure 2:
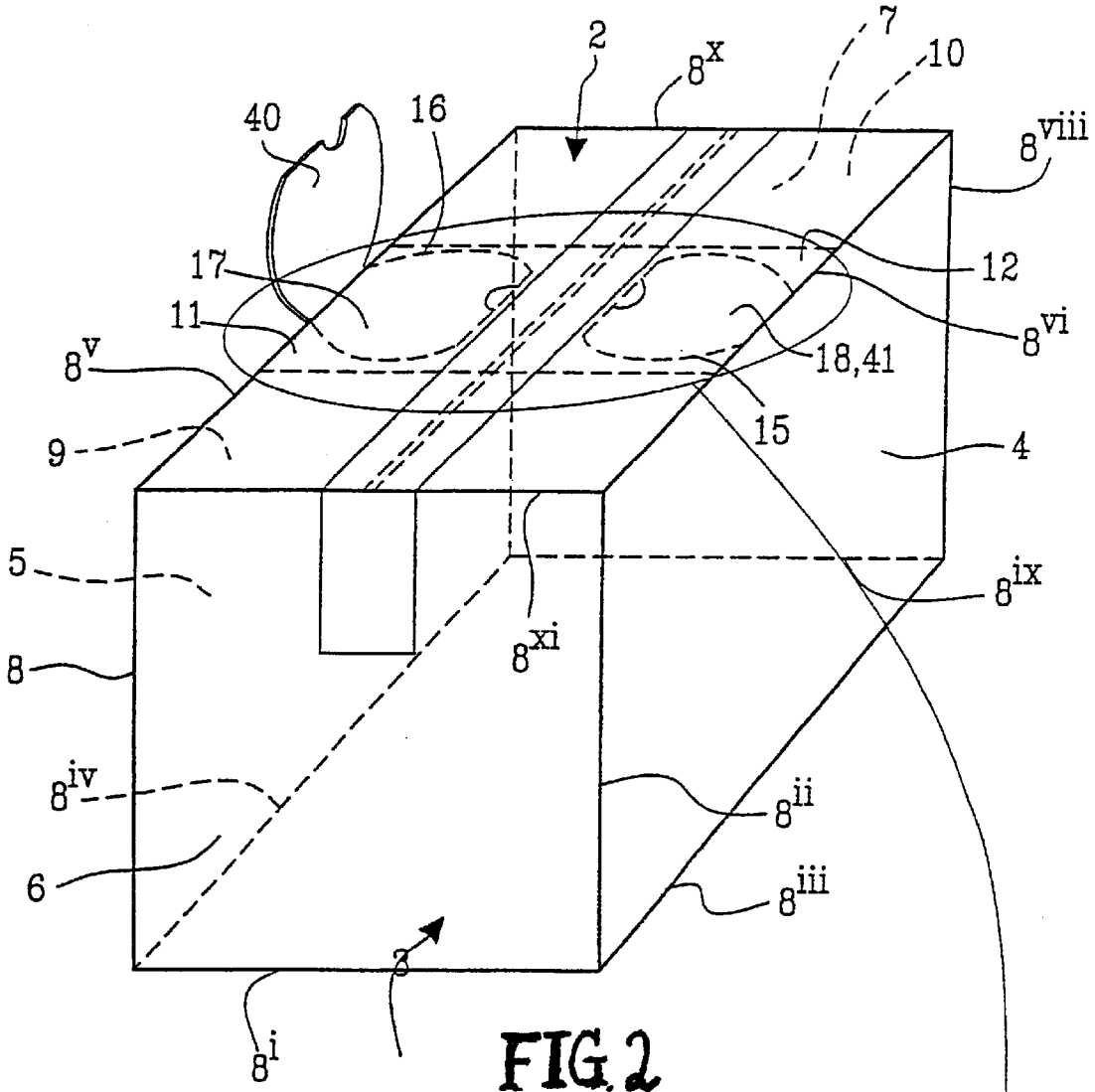
FIG. 2 illustrates a blank for a box according to the invention.
Figure 2A:
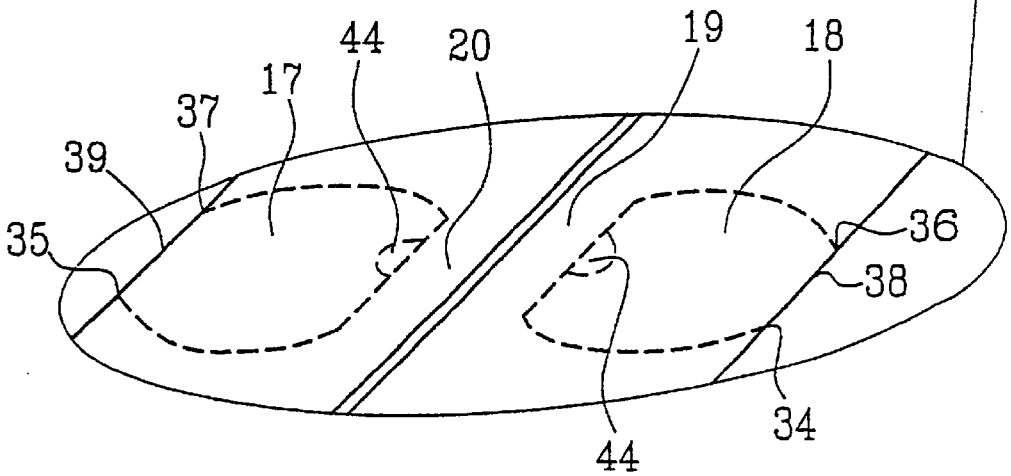
FIG. 2*a* shows an enlargement of a portion of FIG. 2

In FIG. 1 a perspective view over a box, generally denoted by 1, is shown. In FIG. 2 a blank for forming a box according to the invention is shown. The description below refers to both FIG. 1 FIG. 2 and FIG. 2*a*

The box A is formed from a blank (see FIG. 2) of stiff but foldable board material. The board material can be of any known type, for instance corrugated board or paper board. The board could be coated, laminated with a plastic film material or raw, that is not coated or laminated. A coating or plastic film is normally added for improving printing quality. A plastic film could function as a barrier for fluids.

The box 1 comprises a top panel 2, a bottom panel 3 two side panels 4, 5 and two end panels 6,7 connected together at fold lines 8–8$^{vi}$ to form an enclosure. The enclosure is thus a normal box shaped container of board material. The size of the container is adapted for dispensing, storage and freight and could be of any size. Preferably, a size of the boxes is adapted for storage on a standardised pallet, for instance an euro-pallet. Boxes with an adapted size could have a width of 23 cm, a length of 39 cm and a height of 24 cm.

In a preferred embodiment of the invention, the box together with its contents has a weight of less than 10 kg. For the weight to be less than 10 kg, the dimensions need to vary accordingly to the specific weight of the product carried the box.

The top panel 2 is formed by end panels flaps 9, 10 extending from the end panels 6, 7 towards each other and by side panel flaps 11,12 extending from the side panels 4,5 towards each other. Thus, when forming the box from a blank, first a wrap-around is created. This is done by joining a free end panel 6 to a free side panel 5 by adhering an extension 43 of either the free end panel or the free side panel to the other free end or side panel where the extension is not positioned. The forming of a wrap-around is a standard procedure known to the man skilled in the art. The next step to take is either to form the bottom panel 3, which is done by any standard procedure known to the skilled man in the art or to form the top panel 2 according to the invention. The top panel is formed by first folding the end panel flaps 9, 10 inwardly towards each other to be positioned at approximately right angles to the end panels 6, 7. Then the side panel flaps 11, 12 are folded inwardly towards each other to be positioned at approximately right angles to the side panels 4, 5. The side panel flaps 11, 12 are advantageously positioned on top of the end panel flaps 9,10 and adhered to the end panel flaps 9,10 by gluing, thereby creating a more rigid box. It is possible, but not preferred, to position the end panel flaps 9, 10 on top of the side panel flaps 11, 12.

The side panels flaps 11,12 are connected to each other by a tape 13 extending from one of said end panels 6 to the other end panel 7 and attached to a part of each end panel. In a preferred embodiment, the tape is attached to at least ¼ of the height of the end panel. In a more preferred embodiment the tape is attached to at least ⅓ of the height of the end panel. The tape 13 has a triple function, it serves as a seal for the box 1, it provides force pressing the side panel flaps towards the end panel flaps enabling the box to remain in a closed state, and it provides a reinforcement for a handle 14 provided in the top panel 2.

If the box is made of raw board material, that is the board is neither coated, nor provided with a plastic film laminate, the tape is preferably a paper based tape having a water based adhesive. By using a paper tape provided with a water based adhesive, a strong bond is created between the box and the tape. This bond achieves an interaction between the fibers of the cardboard in the box and the fibers in the tape.

If the box is made of a board material laminated with a plastic film, the tape is preferably a plastic tape.

In a preferred embodiment, the tape is fibre reinforced. The reinforcement could be provided by continuous filaments or by yams. According to a further preferred embodiment the filaments extend in the length direction of the tape. Furthermore, according to a more preferred embodiment, the tape is also provided with reinforcing filaments or yarns running at an angle to the length direction of the tape. The tape is in a most preferred embodiment provided with a set of yams or filaments extending in the length direction of the tape and at least two filaments or yarns running in criss-cross patterns crossing each other.

According to the invention the side panel flaps 11, 12 are each provided with perforations 15, 16 defining a dispensing opening 17, 18 located on each side panel flap. The dispensing opening 17, 18 is normally of a size that allows a hand wearing a glove to easily access the interior of the box for removing articles, preferably wipers of tissue, paper or nonwoven material, from the box. The dispensing openings 17, 18 also provide access to the handle 14 which is defined by portions 19, 20 of each side panel flap 11, 12 separating the dispensing openings 17, 18 together with the tape 13.

Thus the handle 14 is formed by parts of opposing side panel flaps and has a reinforcement formed by a tape 13 serving to seal the box. The handle 14 is accessible from dispensing openings 17, 18 provided in the side panel flaps.

The handle 14 is used by inserting a hand through one or both of the dispensing openings 17, 18 and grasping a mid-portion between the dispensing openings 17, 18

For providing good balance to the box, when carried by the handle, the dispensing openings 17, 18 and thus the handle are in a preferred embodiment positioned midway between the two end panels.

In a preferred embodiment each dispensing openings 17,18 has a shape which is generally that of a semi circle or half oval. The periphery of dispensing openings 17, 18 includes portions 21, 22 forming edges of the handle 14 and side portions 23–26 extending from the edges 21,22 of the handle 14. Said portions 21,22 or edges extend substantially parallel to a remote edge 27, 28 of each side panel flap 11, 12. In a preferred embodiment, the transition $\mathbf{30}^{i}$–$\mathbf{30}^{iv}$ from the edges 21,22 of the handle 14 to the side portions 23–26 has a curvature radius of at least 10 mm. In a further preferred embodiment, the transitions have a curvature radius of at least 15 mm. By providing a large curvature radius the box is given a higher resistance to tearing in this region.

The dispensing opening 17, 18 has an extension in the direction from end panel 6 to end panel 7, leaving a portion of the side panel flaps 1 1, 12 intact at a region close to the end panel. In a preferred embodiment of the invention, the dispensing openings 17,18 have a lengthwise extension of 20–60% of the length of a side panel flap 11,12 from end panel 6 to end panel 7. In a preferred embodiment, each end panel flap has a length, positioning a remote edge 32, 33 of each end panel flap 9, 10 flap at a close distance to said side portions 23–26. If the extension of the dispensing openings is 20–60% of the length of a side panel flap, the length of the end panel flaps is preferably of about 40–20% of the length of a side panel flap. Thus, in a preferred embodiment, the length of the lengthwise extension of a dispensing opening and two end flaps should add up to the length of a side flap with a deviation of less than 15%. In a further preferred embodiment, the minimum distance from the remote edge of each end panel flap is less than 5 mm.

The dispensing openings 17, 18 are provided by perforating the blank in the side panels flaps. In a preferred embodiment the perforations forming the side portions 23–26, the edges 21,22 of the handle 14 and the transitions $\mathbf{30}^{i}$-$\mathbf{30}^{iv}$ defining each dispensing opening, extend from a starting point 34, 35 to an end point 36,37 leaving a non-perforated gap 38, 39 used as a hinge for a lid 40, 41: Each lid 40,41 is defined by part of each side panel flap enclosed by said perforations. Said gap or hinge 38,39 enables the lid to be opened for providing access to the interior of the box via the dispensing opening and to be closed for providing dust protection of the interior of the box.

In FIG. 1 one lid 40 is shown in its open state, and another lid 41 is shown in its closed state. In a preferred embodiment of the invention the start and end points 34–37 of the perforations defining each dispensing opening 17, 18 are located on an edge portion of the box $\mathbf{8}^{v}$, $\mathbf{8}^{vi}$. By providing the hinge at the fold lines between the top panel and side panel, the lid could be folded backwards to be out of the way for a user.

In a preferred embodiment the lid could be provided with a thumb grip 44 for facilitating the opening of the Ed.

The bottom panel could be constructed in any conventional way and will therefore not be described in detail.

In FIG. 2 a blank for forming a box according to the invention is shown. FIG. 2 shows most of the details of the box shown in FIG. 1 and the reference numbers have been placed in one or both of the drawings depending on what provides the best understanding of the invention for the reader.

FIG. 2 shows a blank of stiff but foldable board material comprising a first 4 and a second 5 side panel, a first 6 and a second 7 end panel, a first set of end 9, 10 and side 11, 12 panel flaps extending from the end 6, 7 and side 4, 5 panels adapted to form a top panel 2, and a second set 42–$\mathbf{42}^{iii}$ of end and side panel flaps extending from the end and side panels adapted to form a bottom panel 3. Said panels and panel flaps being connected together at fold lines 8–$\mathbf{8}^{xi}$ to form an enclosure.

The blank further includes an extension 43 adapted to connect a side panel with an end panel, leaving only the top panel 2 and bottom panel to be closed before completing an enclosure of the box.

The side panel flaps 11,12 are each provided with perforations defining a dispensing opening 17,18, wherein portions 19,20 of each side panel separating each dispensing opening 17,18 from the remote edge 27,28 of each side panel flap 11,12 are adapted to form a handle 14. The handle is reinforced by a tape 13, which also seals the box and keeps the box closed.

The invention also relates to an article dispenser comprising a box according to the invention. The box carries one or more separate piles of wipers. In a preferred embodiment the article dispenser include two separate piles of wipers positioned side by side, each pile being located under one of the side panel flaps included in the box. In another embodiment the box carries a single pile of wipers. In such an embodiment each wiper is accessible from both dispensing openings provided in the box. In still another embodiment, the box carries four piles of wipers arranged side by side with two piles being located under each side panel flap.

The invention furthermore relates to a first and second method for providing a reinforced handle on a box having dispensing openings on a top panel. In the first method the box is filled with goods before providing the reinforcement. In the second method the box is filled with goods after the reinforcement is provided.

According to the first method the following steps are taken:

- A blank for a box having two side panels, two end panels, a first set of side and end panel flaps and a second set of side and end panel flaps is provided.
- Perforations for forming dispensing openings on the first set of side panel flaps are provided.
- A wrap around is created by connecting an end panel to a side panel.
- A bottom panel is formed of said second set of side and end panel flaps.
- The intended goods in the box are loaded through the remaining opening at the top panel.
- A top panel is formed by folding the first set of side and end panel flaps.
- In a preferred embodiment he side panel flaps 11, 12 are positioned on top of the end panel flaps 9,10 and adhered to the end panel flaps 9,10 by gluing, thereby creating a more rigid box. It is possible, but not preferred, to position the end panel flaps 9, 10 on top of the side panel flaps 11, 12.
- The top panel is closed by connecting said side panel flaps to each other by a tape extending from one of said end panels to the other end panel and preferably attached to a part of each end panel. In a preferred embodiment the tape is attached to at least ¼ of the height of the end panel. In a more preferred embodiment the tape is attached to at least ⅓ of the height of the end panel. The tape thereby reinforces a handle formed by portions of each side panel flaps separating the dispensing openings, The tape seals the box , holds the flaps in position and keeping the box in closed state.

According to a second method the following steps are taken:

A blank for a box having two side panels, two end panels, a first set of side and end panel flaps and a second set of side and end panel flaps is provided.

Perforations for forming dispensing openings on the first set of side panel flaps are provided.

A wrap around is created by connecting an end panel to a side panel.

A top panel is formed by folding the first set of side and end panel flaps.

In a preferred embodiment he side panel flaps 11, 12 are positioned on top of the end panel flaps 9,10 and adhered to the end panel flaps 9,10 by gluing, thereby creating a more rigid box. It is possible, but not preferred, to position the end panel flaps 9, 10 on top of the side panel flaps 11, 12.

The top panel is closed by connecting said side panels flaps to each other by a tape extending from one of said end panels to the other end panel and preferably attached to a part of each end panel. In a preferred embodiment the tape is attached to at least ¼ of the height of the end panel. In a more preferred embodiment the tape is attached to at least ⅓ of the height of the end panel. The tape thereby reinforces a handle formed by portions of each side panel flap separating the dispensing openings. The tape seals the box, holds the flaps in position and keeps the box in closed state.

The intended goods in the box are loaded through the remaining opening at the bottom panel.

A bottom panel of said second set of side and end panel flaps is formed and thereby the box is closed.

The invention furthermore relates to an alternative embodiment of a box formed from a blank of stiff but foldable board material comprising a top (2) panel ,a bottom panel (3), two side panels (4,5) and two end panels (6,7) connected together at fold lines (8–8$^{xi}$) to form an enclosure, wherein said top panel (2) is formed by side panel flaps (11,12) extending from the side panels (6,7) towards each other, said side panels flaps (11,12 are connected to each other by a tape (13) extending from one of said end panels (6) to the other end panel (7). In this embodiment of the invention, the box could be provided with only one dispensing opening provided in one of the side panel flaps. In this case the handle 14 is formed by a part of the top panel accessible from a dispensing opening provided in at least one of said side panel flaps, said handle is reinforced by the tape 13.

It is of course possible to combine the advantageous features of the embodiments claimed in claims 1–13, with the alternative embodiment.

In the description and claims a top panel is defined as a panel formed by side panel flaps provided with perforations defining a dispensing opening preferably together with end panel flaps. A bottom panel is the panel on the opposite side of a top panel. A side panel is a panel having at lest one side panel flap provided with perforations defining a dispensing opening. The end panels are the two remaining panels. Printing on the box could indicate that the box is intended to be positioned with the bottom, side or end panel facing upwardly. Furthermore the wording end and side panels does not indicate any particular size relationship between the panels.

What is claimed is:

1. A box formed from a blank of stiff but foldable board material, the box comprising a top panel, a bottom panel, two side panels and two end panels connected together at fold lines to form an enclosure, wherein said top panel is formed by end panel flaps extending from the end panels towards each other and by side panel flaps extending from the side panels towards each other, said side panels flaps being connected to each other by a tape extending from one of said end panels to the other end panel wherein the side panel flaps are each provided with perforations defining a dispensing opening, wherein portions of each side panel flap separating the dispensing openings, together with the tape, are adapted to form a handle.

2. The box according to claim 1, wherein the tape acts as reinforcement for the handle and as a closure for the box.

3. The box according to claim 1, wherein each end panel flap is glued to the side panel flaps, thereby increasing the rigidity of the box and the strength of the handle.

4. The box according to claim 3, wherein each dispensing opening extends, in a direction from end panel to end panel between side portions of said each dispensing opening and that each end panel flap has a length, positioning a remote edge of each end panel flap at a close distance to said side portions.

5. The box according to claim 4, wherein the minimum distance from the remote edge of each end panel flap to said side portions of said dispensing openings is less than 5 mm.

6. The box according to claim 1, wherein said perforations defining each dispensing opening extend from a starting point to an end point leaving a non-perforated gap used as a hinge for a lid defined by part of each side panel flap enclosed by said perforations and said gap enabling the lid to be opened for providing access to the interior of the box via the dispensing opening and to be closed for providing dust protection for the interior of the box.

7. The box according to claim 6, wherein the box is provided with edge portions separating the top panel from the side panels wherein the start and end points of the perforations defining each dispensing opening are located on said edge portion of the box.

8. The box according to claim 1, wherein each dispensing opening comprises an edge of the handle 14 extending substantially parallel to a remote edge of each side panel flap and side portions extending from the edge, wherein transitions from the edge to the side portions have a curvature radius of at least 10 mm.

9. The box according to claim 1, wherein the tape is reinforced by fibres.

10. The box according to claim 1, wherein the box is made of a non-coated board and the tape is a paper provided with a water based adhesive.

11. A blank of stiff but foldable board material comprising a first and a second side panel, a first and a second end panel, a first set of end and side panel flaps extending from the end and side panels adapted to form a top panel, and a second set of end and side panel flaps extending from the end and side panels adapted to form a bottom panel said panels and panel flaps connected together at fold lines to form an enclosure, wherein the side panel flaps are each provided with perforations defining a dispensing, opening, wherein a portion of each side panel flap separating said dispensing opening from a remote edge of the side panel flap is adapted to form a handle together with a tape.

12. An article dispenser comprising a box according to claim 11, and one or more separate piles of wipers accessible from dispensing openings provided in the side panel.

13. A method of providing a reinforced handle on a box having perforations defining dispensing openings, wherein the method comprises the following steps:

providing a blank for a box having two side panels, two end panels, a first set of side and end panel flaps and a second set of side and end panel flaps, providing perforations for forming dispensing openings on the first set of side panel flaps, forming a bottom panel of said second set of side and end panel flaps, loading the intended goods in the box through the remaining opening at the top panel, folding the first set of side and end panel flaps to form a top panel, closing the top panel by connecting said side panels flaps to each other by a tape extending from one of said end panels to the other end panel thereby creating a reinforcement of a handle formed of portions by each side panel flaps separating the dispensing openings and the tape.

14. A method of providing a reinforced handle on a box having perforations defining dispensing openings, wherein the method comprises the following steps:

providing a blank for a box having two side panels, two end panels, a first set of side and end panel flaps and a second set of side and end panel flaps, providing perforations for forming dispensing openings on the first set of side panel flaps, folding the first set of side and end panel flaps to form a top panel, closing the top panel by connecting said side panel flaps to each other by a tape extending from one of said end panels to the other end panel thereby creating a reinforcement of a handle formed by portions of each side panel flaps separating the dispensing openings and the tape, loading the intended goods in the box through the remaining opening at the bottom panel, forming a bottom panel of said second set of side and end panel flaps and thereby closing the box.

15. A box formed from a blank of stiff but foldable board material comprising a top panel, a bottom panel, two side panels and two end panels connected together at fold lines to form an enclosure, wherein said top panel is formed by side panel flaps extending from the side panels towards each other, said side panel flaps are connected to each other by a tape extending from one of said end panels to the other end panel wherein a handle is formed by a part of the top panel accessible from a dispensing opening provided in at least one of said side panel flaps and that said handle is reinforced by the tape.

* * * * *